US005435758A

United States Patent [19]

Sasai et al.

[11] Patent Number: 5,435,758

[45] Date of Patent: Jul. 25, 1995

[54] ELECTRICAL CONNECTOR WITH TERMINAL RETAINING MEANS

[75] Inventors: Osamu Sasai; Kiyofumi Ichida, both of Yokkaichi, Japan

[73] Assignee: Sumitomo Wiring Systems, Ltd., Mie, Japan

[21] Appl. No.: 194,001

[22] Filed: Feb. 9, 1994

[30] Foreign Application Priority Data

Feb. 10, 1993 [JP] Japan ..... 5-045935

[51] Int. Cl.[6] ..... H01R 13/436

[52] U.S. Cl. ..... 439/752

[58] Field of Search ..... 439/752, 595

[56] References Cited

U.S. PATENT DOCUMENTS 4,946,398 8/1990 Takenouchi et al. ..... 439/752

5,057,042 10/1991 Yamanashi et al. ..... 439/752

FOREIGN PATENT DOCUMENTS 2071926 9/1981 United Kingdom ..... 439/752

*Primary Examiner*—Gary F. Paumen

*Attorney, Agent, or Firm*—Wenderoth, Lind & Ponack

[57] ABSTRACT

An electrical connector includes a housing having a plurality of cavities receiving a plurality of terminals therein, respectively, and an opening communicating with the terminal receiving cavities, and a retainer. The retainer includes a body engaged with the housing and movable in parallel with a longitudinal axis of the housing, and lock strips each coupled to the body and pivotable. Each lock strip is engaged with the housing through a guide which causes the lock strip to pivot inwardly and outwardly of the housing as the retainer is moved parallel to the longitudinal axis of the housing. Each lock strip has protrusions extending through the opening of the housing. The protrusions are moved inwardly and outwardly relative to the opening of the housing when each lock strip is pivot inwardly and outwardly of the housing. The lock strips engage the terminals received in the cavities, respectively, such that the terminals are held in position by the retainer.

10 Claims, 6 Drawing Sheets

ELECTRICAL CONNECTOR WITH TERMINAL RETAINING MEANS

BACKGROUND OF THE INVENTION

1. Field of the Invention

This invention relates to an electrical connector having cavities receiving terminals each of which has one end connected to a lead, and more particularly to such a connector employing a retainer providing double engagement for the terminals received in the cavities so that the terminals can be held in position therein.

2. Description of the Prior Art

FIGS. 7 and 8 illustrate a conventional electrical connector employing a retainer providing double engagement for the terminals. FIGS. 9 and 10 illustrate another conventional connector employing such a retainer. Referring to FIGS. 7 and 8, the connector comprises a housing 1 with cylindrical cavities 1*a* receiving respective terminals 2. Each cavity 1*a* has an open rear end through which the terminal 2 is inserted. A cap-shaped retainer 3 is fitted on an outer periphery of the rear end of the housing 1. The retainer 3 has terminal insertion apertures 3*a* corresponding to the respective rear openings of the cavities 1*a*. A protrusion 3*b* is formed on the upper inner periphery of the retainer 3 so that it protrudes toward the interior of the enters into the corresponding cavity 1*a* to collide with the rear end of the terminal 2. The state of the housing 1 and the retainer 3 as shown in FIG. 8 will be referred to as "full engagement".

The retainer 3 can be engaged with the housing 1 before the full engagement state, assuming a position away from its position in the full engagement state, as shown in FIG. 7. In this position away from that in the full engagement state, each protrusion 3*b* is out of the corresponding cavity 1*a*. The state of the housing 1 and the retainer 3 as shown in FIG. 7 will be referred to as "preliminary engagement".

When assembling the above-described connector, the terminals 2 are inserted into the cavities 1a from the terminal insertion apertures 3*a*, respectively, with the housing 1 and the retainer 3 in the state of preliminary engagement. After being forced down in the direction of arrow A from the preliminary engagement state shown in FIG. 7, the retainer 3 is thrust in the direction of arrow B in FIG. 8. Thus, a two-stage operation is necessitated in order that the retainer 3 is engaged with the housing 1 in the full engagement state, that is, pushing the retainer 3 in the direction of arrow A and thrusting it in the direction of arrow B. The two-stage operation requires an operator to be well-skilled, resulting in a problem in working efficiency. Furthermore, the two-stage operation prevents automatization of the terminal inserting work.

On the other hand, the connector shown in FIGS. 9 and 10 comprises a housing 4 with cylindrical cavities 4*a* receiving terminals 5, respectively. A space or retainer receiving portion 4*b* is defined in an upper rear portion of the housing for receiving a retainer 6. The retainer 6 has at its distal end a flexible arm 6*a* and is inserted into the retainer receiving portion 4*b* as led by the arm 6*a*. The retainer 6 has a rear end which is engageable at its top face with an upper face of the retainer receiving portion 4*b*. The retainer 6 is engaged with the retainer receiving portion 4*b* both when it assumes a preliminary engagement position in which the base is not completely received in the retainer receiving portion 4*a*, as shown in FIG. 9, and when it assumes a full engagement position in which it is completely received in the retainer receiving portion 4*b*.

The retaining receiving portion 4*b* has an inclined face 4*c* at its front end. The distal end of the arm 6*a* is positioned rearwardly of the open end of the housing relative to the inclined face 4*c* when the retainer 6 is at the preliminary engagement position. When the retainer 6 is moved from the preliminary engagement position to the full engagement position, the distal end of the arm 6*a* is flexed downwardly along the inclined face 4*c* so that the arm 6*a* advances downwardly into the cavity 4*a*.

To assemble the above-described connector, the retainer 6 is inserted into the retainer receiving portion 4*b* as led by the arm portion 6*a* such that the retainer 6 is engaged with the housing at the preliminary engagement position. Then, the terminals 5 are inserted into the respective cavities 4*a* and the retainer 6 is thrust in the direction of arrow C in FIG. 10 such that it is moved from the preliminary engagement position to the full engagement position. The arm 6*a* of the retainer 6 then collides with the inclined faces 4*c* to be flexed downwardly. The arm 6*a* then collides with a portion of the terminal 5 defining the bottom of a recess 5*a* to push the same deep into the cavity 4*a*, thereby holding the terminals 5 in the respective cavities 4*a*.

The number of the arms 6*a* to be flexed corresponds to the number of the terminals received in the respective cavities 4*a*. Accordingly, a large operating force is necessary when there are a large number of terminals 5 and results in reduction in the working efficiency. Furthermore, the arm 6*a* loses its resiliency when the retainer 6 is returned to the preliminary engagement position during an inspection of the connector. In this case, the arm 6*a* remains bent downwardly and accordingly, the terminal 5 cannot be pulled out.

SUMMARY OF THE INVENTION

Therefore, an object of the present invention is to provide an electrical connector which can be assembled readily and wherein the retainer can be guided by guide means having a simple structure.

The present invention provides an electrical connector comprising a housing having a plurality of cavities receiving a plurality of terminals therein, respectively, and an opening communicating with the terminal receiving cavities. A retainer includes a body engaged with the housing and movable in parallel with the same and at least one lock strip coupled to the body and pivotable relative thereto. Each lock strip is engaged with the housing through guide means which guides the lock strip toward and away from the housing upon movement of the body parallel to the housing. Each lock strip has protrusions extending into the opening of the housing and engaging the respective terminals received in the respective cavities such that the terminals are held in position by the retainer.

When the lock strip is moved toward the housing by the guide means when the body of the retainer is moved in one direction parallel to the housing, the protrusions of the lock strip move into the cavities from the opening of the housing. The protrusions are engaged with the respective terminals to hold them in position. On the other hand, when the retainer body is moved in the opposite direction, the lock strip is moved away from the housing by the guide means and the protrusions of the lock strip are caused to move out of the opening of the housing. Consequently, the terminals are disengaged from the respective protrusions of the lock strip and may be taken out of the housing.

Since the protrusions of the lock strip are moved into and out of the housing with the movement of the retainer in the direction parallel to the housing, the connector can be assembled readily. Furthermore, since each lock strip is moved away from the housing by the guide means every time the retainer is withdrawn from the housing, the terminals are never prevented by the lock strips from being removable from the housing.

The guide means may comprise a plurality of guide concave portions of the housing defining guide grooves, and a plurality of guide protrusions formed on the retainer and received in the guide grooves, respectively. Each guide groove is curved so that the lock strip is drawn toward the housing upon movement of the retainer parallel to the housing.

Each guide protrusion moves in the guide groove in engagement with the housing when the retainer body is moved parallel to the housing, so that each lock strip is moved toward and away from the housing. Alternatively, the guide concave portions may be part of the retainer with the guide protrusions formed on the housing. Thus, the guide means has a simple structure consisting of the guide concave portions and the guide protrusions.

In this latter case, the retainer may have two pairs of holding strips each pair holding the housing therebetween, the guide grooves being formed in the holding strips, and the housing may have opposite sides thereof engaged by the holding strips, the guide protrusions extending from the opposite sides of the housing.

Since the holding strips are provided at the opposite sides of each lock strip of the retainer, they are engaged with the housing at both sides of the lock strip.

The housing may have a plurality of guide recesses extending parallel to the direction in which the retainer is movable relative to the housing. The guide grooves are formed at the sides of the guide recesses. The retainer has a plurality of convex portions extending into the guide recesses of the housing, respectively, the guide protrusions extending from the convex portions into the guide grooves.

During assembly, the convex portions of the retainer move into the respective guide recesses of the housing and further move parallel to the housing. The lock strips of the retainer are moved toward and away from the housing by the guide grooves and the protrusions received in the guide grooves, respectively. The guide grooves may be provided either to the side of the guide recesses of the housing as mentioned above or in the side of the guide convex portions of the retainer in which case the guide protrusions are provided in the guide recesses of the housing. If the guide convex portions are provided on the retainer with the guide recesses formed in the housing, the outer sides of the housing can be used for other purposes.

The retainer may include a tubular portion into which the housing is inserted. Since the retainer body is tubular, the retainer body can be moved back and forth axially of the housing. Consequently, the connector can be assembled readily only by insertion of the housing into the retainer.

Furthermore, the retainer may have a plurality of sliding strips holding the housing therebetween at the outer sides of the housing. The sliding strips are in sliding engagement with the outer sides of the housing. The retainer in this case does not have a tubular body, which improves the freedom of the configuration of the retainer of the connector.

Other objects of the invention will become apparent upon obtaining an understanding of the illustrated embodiments about to be described. Various advantages not referred to herein will occur to those skilled in the art upon employment of the invention in practice.

BRIEF DESCRIPTION OF THE DRAWINGS

Several embodiments of the invention will be described with reference to the accompanying drawings, in which.

DETAILED DESCRIPTION OF THE PREFERRED EMBODIMENTS

A first embodiment of the present invention will be described with reference to FIGS. 1 to 4. In the embodiment, the invention is applied to a female connector.

Figure 1:
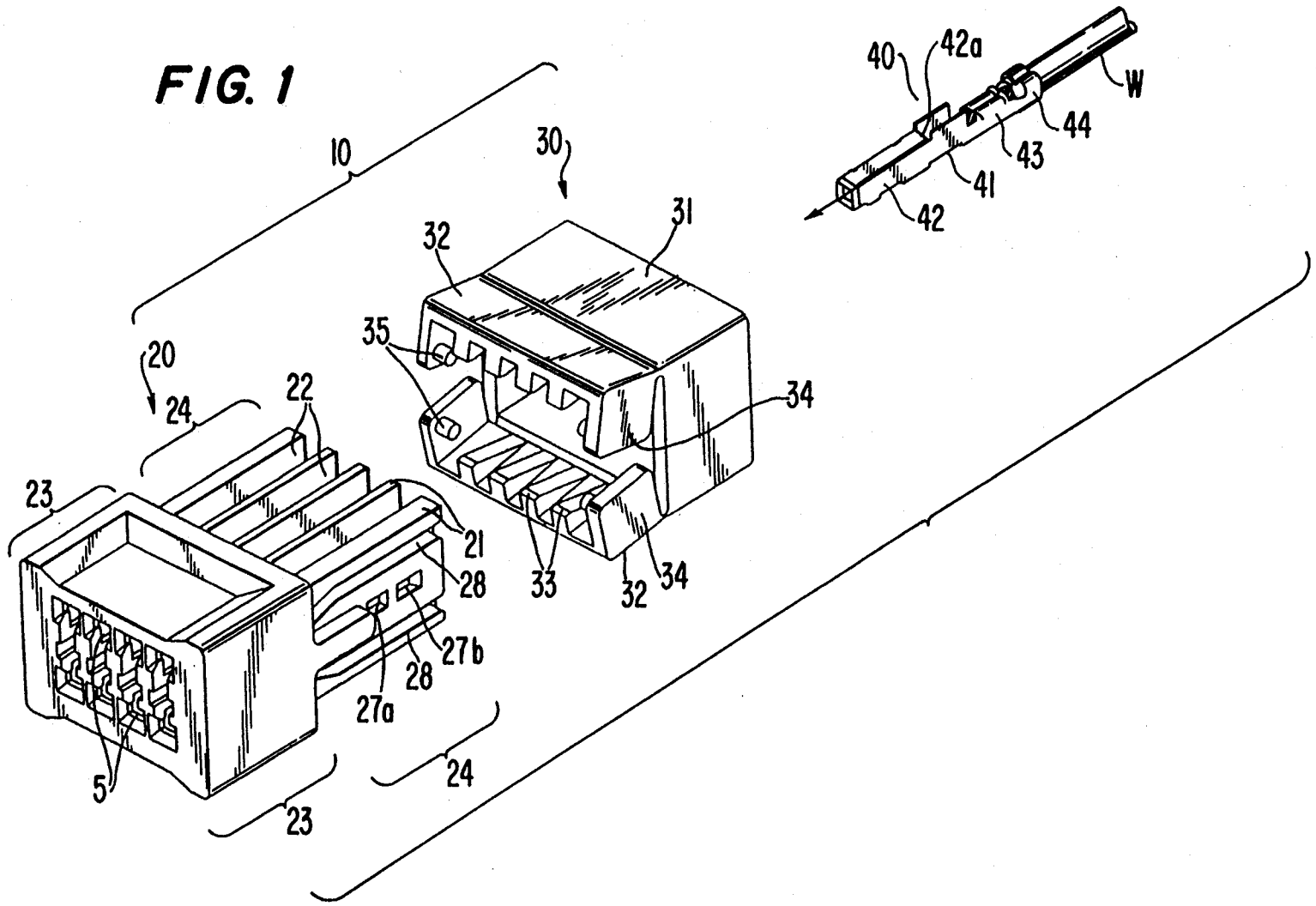
FIG. 1 is an exploded view in perspective of a first embodiment of the electrical connector in accordance with the invention.

Referring to FIG. 1, an electrical connector 10 comprises a housing 20 generally formed into a rectangular parallelepiped and a retainer 30 attached to the rear portion 24 of the housing 20. A plurality of terminals 40 each having an end connected to a lead by way of crimping are enclosed in the housing.

Figure 2:
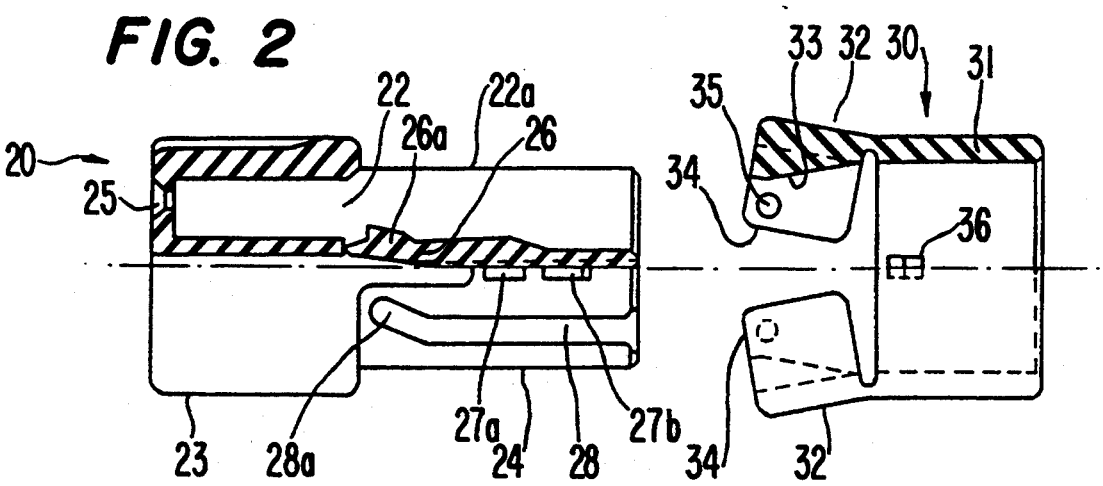
FIG. 2 is a side view, partially in section, of the connector with the retainer being separated from the housing.
Figure 3:
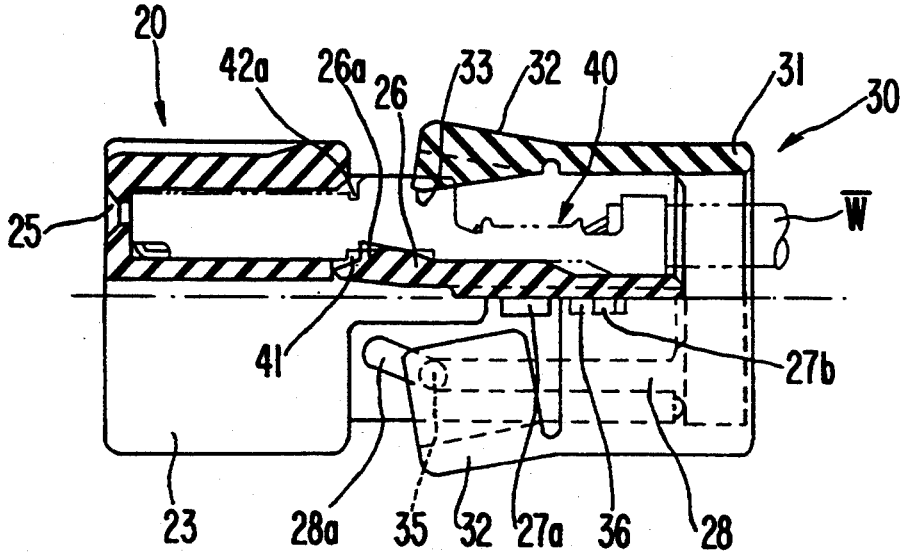
FIG. 3 is a similar view of the connector in the preliminary engagement state.
Figure 4:
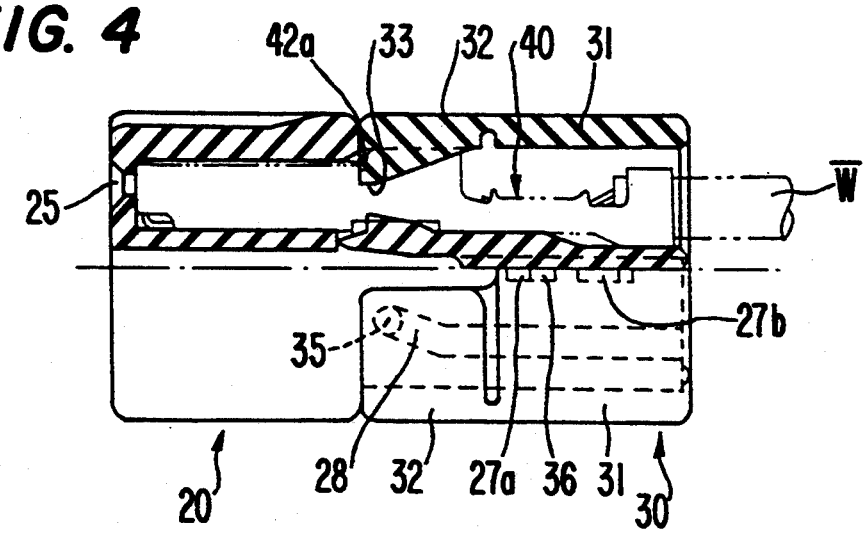
FIG. 4 is a similar view of the connector in the full engagement state.

The interior of the housing 20 is partitioned by partition walls 21 into two rows of terminal receiving cavities 22, each row having four cavities. The front portion 23 of the housing 20 closes the whole periphery of the terminal receiving cavities 22 while the top of the upper row of the cavities 22 and the bottom of the lower row of the cavities 20 are open in the rear portion 24 of the housing 20 such that an opening **22*a* open to both the cavities and an outer surface of the housing is provided, as shown in FIG. 2. A front wall of the front portion 23 has small apertures 25 through which male terminals (not shown) are inserted. Lock arms 26 are formed on the front end of the rear portion 24. Each lock arm 26 can be flexed vertically. Each lock arm 26 has an engagement protrusion 26*a* formed on the upper face thereof. Each engagement protrusions 26*a* has such a configuration that it can be inserted into an engagement aperture 41 formed in the underside of each terminal 40** which will be described later, and held therein.

Two engagement holes 27a, 27b are formed in the vertically middle portion of each of side walls of the rear portion 24. Each side wall of the rear portion further has two guide concave portions 28 defining guide grooves extending from the rear end of the housing toward the front. One guide groove extends under and the other above the engagement holes 27a, 27b. Each guide groove extends generally horizontally from the rear end of the rear portion 24 and is curved at its front end 28a toward the vertically central portion of the housing 20.

The retainer 30 includes a body 31 formed into a rectangular shape and can enclose the rear portion 24 of the housing 20. Two plate-shaped lock strips 32 are formed on the front portion of the body 31. The lock strips 32 are connected to upper and lower walls of the body 31, respectively. Each lock strip 32 has a connection portion whose thickness is reduced such that it is pivotable. Four protrusions 33 are formed on the inside face of each lock strip 32 so as to correspond to the cavities 22. Two holding strips 34 are formed on the right-hand and left-hand sides of each lock strip 32. Each holding strip 34 spreads away from the central portion of the retainer in the vertical direction. A space is defined between the holding strips 34 extend from each lock strip 32 so that the rear portion 24 of the housing 20 can be held therebetween.

Guide protrusions 35 are formed on the inner sides of the holding strips 34, respectively. The guide protrusions 35 are engageable with the respective guide concave portions 28 of the rear portion 24 of the housing 20. The guide protrusions 35 are so positioned that the lock strips 32 remain spread upwardly and downwardly, respectively, when the guide protrusions 35 are inserted into the horizontal portions of the respective guide grooves of the guide concave portions 28. The guide protrusions 35 are further positioned so that each lock strip 32 remains coplanar with the side walls of the body 31 as the protrusions 35 are advancing forward along the respective grooves to reach the front end curved portions 28a. With the above-described movement of each lock strip 32, the protrusions 33 formed on the inner faces of the lock strips 32 invade the cavities 22 from the rear openings thereof. The insertion of the terminals into the respective cavities 22 is not prevented by the protrusions 33 in the condition that they are near the rear ends of the cavities 22.

Both side walls of the body 31 have on their inner faces positioning protrusions 36, respectively, which protrusions 36 are received in the engagement holes 27a or 27b formed in the housing 20, respectively. Now consider the case where the rear portion 24 of the housing 20 is inserted into the body 31 of the retainer 30 in the condition that the guide protrusions 35 of the holding strips 34 are in engagement with the respective guide concave portions 28. The guide protrusions 35 are in the horizontal portions of the grooves defined by the guide concave portions 28 when the positioning protrusions 36 are received in the rear engagement holes 27b, respectively. The guide protrusions 35 are in the curved front ends 28a of the guide grooves when the positioning protrusions 36 are received in the front engagement holes 27a. The guide protrusions 36 are moved out of the engagement holes 27a, 27b when the retainer 30 is forced to move back and forth.

Each terminal 40 has at its front end a tubular portion 42 for covering the respective male terminals for connection thereto. Each terminal 40 has at its rear end a wire barrel 43 and an insulation barrel 44 so that the lead end of the wire W whose sheath of the end portion has been removed is crimped by the respective terminals 22. An engagement aperture 41 is formed in the bottom of each terminal 40 near the rear end of the tubular portion 42. The upper face of the rear end portion 42a of the cylindrical portion 42 is cut out.

The use of the connector will be described. The wire sheath is removed from one end of each wire W and the end is crimped by the terminal 40 at the wire barrel 43 and the insulation barrel 44 beforehand.

Both lock strips 32 of the retainer 30 are slightly spread and then, the retainer 30 is brought close to the rear portion 24 of the housing 20, as shown in FIG. 2. The guide protrusions 35 of the holding strips 34 are inserted into the rear end openings of the upper and lower grooves defined by the guide concave portions 28, respectively. In this state, the rear portion 24 of the housing 20 is inserted into the body 31 of the retainer 30.

Since each guide groove is first horizontal, the guide protrusions 35 advance with each lock strip 32 being spread. Before each guide protrusion 35 reaches the curved portion of the guide groove 28, the positioning protrusions 36 formed on the inner faces of the side walls of the body 31 are received in the rear engagement holes 27b in the rear portion 24 of the housing 20, respectively. Since the positioning protrusions 36 are engaged with the housing 20 in this state, the housing 20 is prevented from being removed from the retainer 30.

In the above-described state, terminals 40 are inserted into the respective cavities 22 from the side of the tubular portion 42. As described above, each lock strip 32 remains in the spread state since the guide protrusions 35 of the retainer 30 are in engagement with the guide concave portions 28 of the housing 20, respectively. In this state, the protrusions 33 are in the respective cavities 22 as positioned slightly inwardly of the upper or bottom opening 22a of the housing 20. Accordingly, each terminal 40 can be inserted without colliding against a protrusion 33. However, since the engagement protrusions 26a of the lock arms 26 protrude from the bottom of the respective cavities 20, each terminal 40 collides at its front end with the engagement protrusion 26a such that each lock arm 26 is flexed downwardly relative to the cavity 22 and each terminal 40 is inserted deep into the cavity 22. Each engagement protrusion 26a faces the engagement aperture 41 formed in the underside of the terminal 40 when it has reached the deepest portion of the cavity 22. Resiliency of the lock arm 26 pushes the engagement protrusion 26a up into the engagement aperture 41 such that the engagement protrusion is held in the engagement aperture 41. This state of the terminals 40 is shown by the chain lines in FIG. 3.

The body 31 of the retainer 30 is further advanced toward the housing 20 when a necessary number of terminals 40 are received in the respective cavities 22. The guide protrusions 35 of the holding strips 34 are positioned before the curved portions of the respective guide grooves defined by the guide concave portions 28 of the housing before advancement of the retainer body 31. Accordingly, with advancement, the guide protrusions 35 enter the curved portions of the guide grooves which extend to the vertically middle portion of the housing 20, respectively. The lock strips 32 come nearer to the housing 20 via the holding strips 34 as the guide protrusions 35 advance toward the middle portion. With this movement of each guide protrusion 35, the protrusions 33 of each lock strip 32 move from the rear to the front of and deeper into the cavities 22.

The distal end of each lock strip 32 advances to the connection point of the front and rear portions 23, 24 when the guide protrusions 35 reach the ends of the respective guide grooves. Furthermore, the protrusions 33 become parallel to the body 31 and extend most deeply into the respective cavities 22. Since the positioning protrusions 36 of the retainer body 31 are received in the front engagement holes 27*a* of the housing 20, respectively, the retainer 30 and the housing 20 can be prevented from being displaced. The underside engagement hole 41 of each terminal 40 receives the engagement protrusion 26*a* such that each terminal 40 is held in position. Furthermore, the protrusion 33 of each lock strip 32 collides with the rear end portion 42*a* of each tubular portion 42 such that each terminal 40 is also held in position. Thus, each terminal 40 is held in the cavity 22 by a double engagement structure.

A force pushing each terminal 40 rearwardly flexes each lock strip 32 outwardly via the protrusions 33. However, since the housing 20 is held by the holding strips 34 of the lock strips 32, the lock strips 32 are stably drawn to the housing 20 and accordingly, each terminal 40 can be prevented from being disengaged from the protrusions 33.

There is a possibility that the terminal 40 is not reliably engaged with the lock arm 26 when the terminal 40 is not inserted all the way into the cavity 22. In the embodiment, however, a protrusion 33 of the retainer 30 collides with the rear end portion 42*a* of the tubular portion 42 of the terminal 40. Consequently, the terminal 40 is pushed to its normal position when it has not been inserted all the way into the cavity 22.

Figure 5:
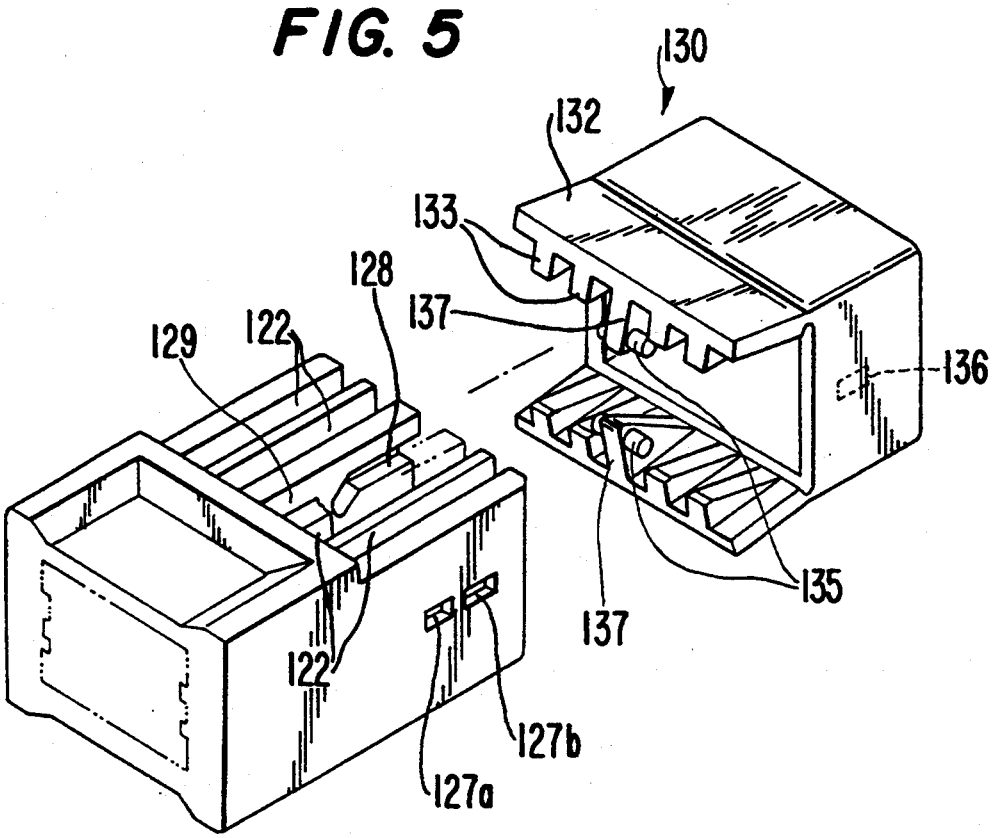
FIG. 5 is an exploded view in perspective of a second embodiment of the connector.

FIG. 5 illustrates a second embodiment of the invention. In the first embodiment, each lock strip 32 of the retainer 30 is provided with the holding strips 34 holding the rear portion 24 of the housing 20 therebetween. In the second embodiment, each lock strip 132 of the retainer 130 has a central guide convex portion 137 projecting further than the protrusions 133. Two guide protrusions 135 are formed on sides of the distal end of each convex portion 137. Furthermore, the housing 120 has two guide recesses 129 each formed in the middle portion of each row of the cavities 122. Each guide convex portion 137 enters a corresponding guide recess 129. Each guide recess 129 has at its sides guide grooves receiving the respective guide protrusions 135. These guide grooves are defined by guide concave portions 128 of the housing 120.

To assemble this connector, the guide protrusions 135 are aligned with the rear of the guide grooves defined by the concave portions 128, and the guide convex portions 137 are inserted into the respective guide recesses 129. The housing 120 is inserted into the retainer 130 until the positioning protrusions 136 are received in the rear engagement apertures 127*b* of the housing 120, respectively, whereupon the terminals are inserted into the respective cavities 122. When the necessary number of terminals are received in the respective cavities 122, the body 131 of the retainer 130 is advanced toward the housing 120. The guide protrusions 135 projecting from the guide convex portions 137 move along the front end curved portions of the guide grooves and are drawn toward the vertically middle portion of the housing 120 such that the protrusions 133 of the lock strips 132 invade the cavities 122, respectively, thereby engaging the respective terminals to hold them in position.

Since the sides of the housing 120 are not covered by the respective lock strips 132, the sides of the housing 120 may have various shapes, which improves the freedom in design.

Figure 6:
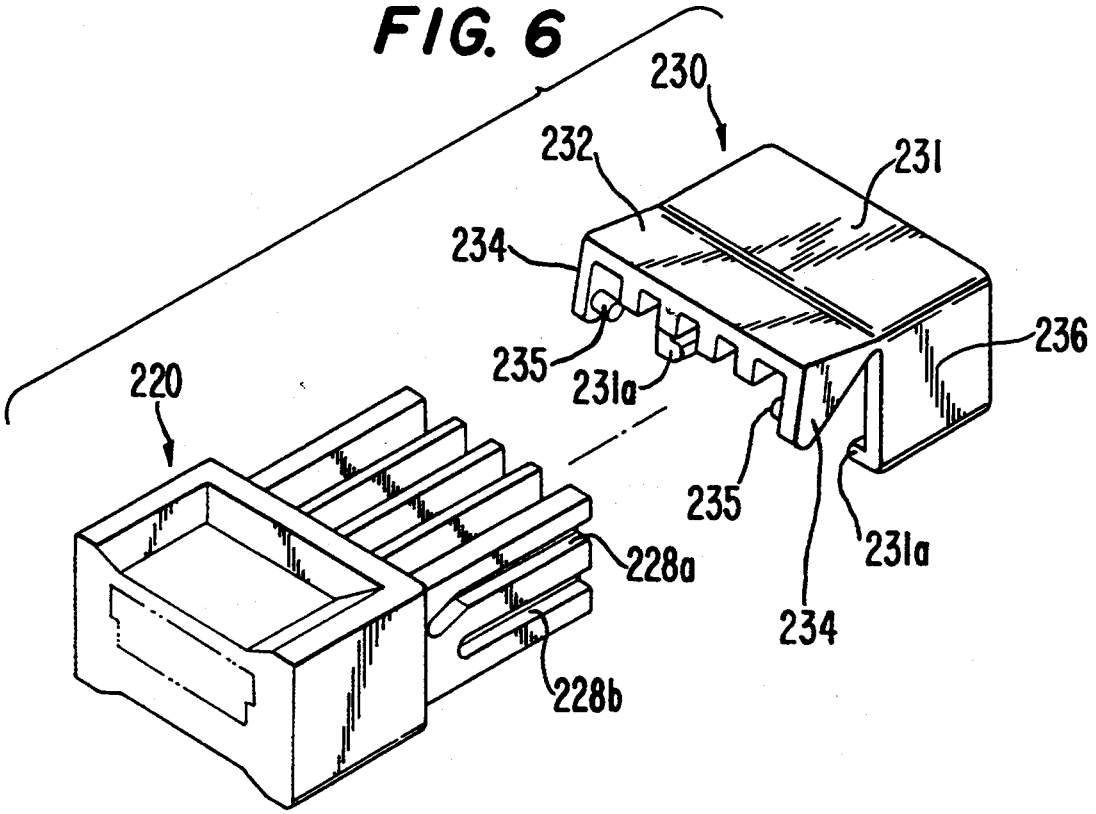
FIG. 6 is an exploded view in perspective of a third embodiment of the connector.
Figure 7:
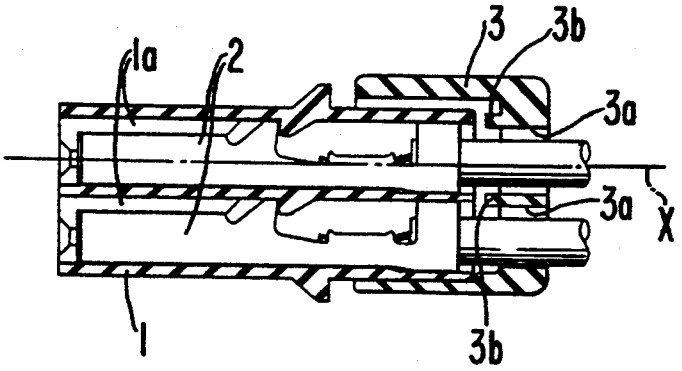
FIG. 7 (PRIOR ART)
FIG. 7 is a longitudinal sectional view of a conventional connector with the retainer assuming the preliminary engagement position.
Figure 8:
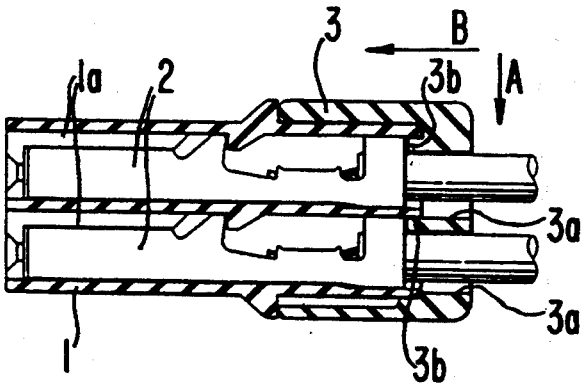
FIG. 8 (PRIOR ART)
FIG. 8 is a longitudinal sectional view of a conventional connector with the retainer assuming the full engagement position.

FIG. 6 illustrates a third embodiment. In the first embodiment, the body 31 of the retainer 30 has such a shape that the rear portion 24 of the housing 20 can be inserted into it so that the retainer 30 can be moved parallel to the housing 20. In the third embodiment, horizontal grooves 228*b* are formed in the opposite sides of the housing 220 along with the curved guide grooves defined by the guide concave portions 128*a*. The body 231 of the retainer 230 has an open underside and sliding strips 236. The lower ends of the respective sliding strips (side walls) 236 are bent inwardly so that protrusions 231*a* moved parallel to the housing 220 will extend in the respective horizontal grooves 228*b*.

To assemble the connector, the guide protrusions 235 of the holding strips 234 of the retainer 230 are aligned with the curved guide grooves defined by the concave portions 228*a* of the housing 220, respectively, and the guide protrusions 235 are advanced in the respective curved guide grooves. When the front end of the retainer body 231 comes close to the rear end of the housing 220, the lower end protrusions 231*a* of the retainer body 231 are received in the horizontal grooves 228*b*, respectively, and the retainer 230 is advanced relative to the housing 220. The positioning protrusions and the engagement holes can be formed in respective suitable portions although they are not shown in the figure.

In the case where the connector has only a single row of terminal receiving cavities 222, it can be rendered compact by eliminating the tubular portion of the retainer 230 and providing only the sliding strips 236 holding the housing 220 therebetween. In the third embodiment, too, the same central guide convex portion as that shown in FIG. 5 may be formed on the retainer body so as to be received in a guide recess and moved back and forth parallel to the housing. Additionally, both the lock strip and the sliding strips 236 of the retainer body can be engaged with the housing when the guide protrusion is received only in the horizontal portion of the guide groove.

Figure 9:
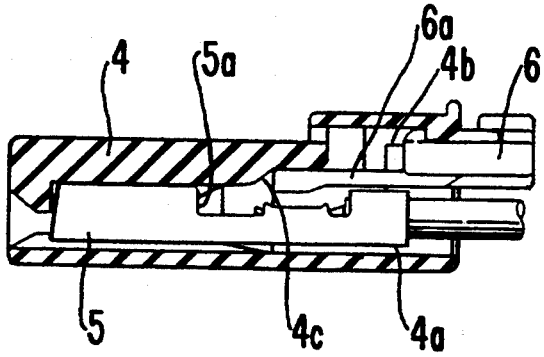
FIG. 9 (PRIOR ART)
FIG. 9 is a longitudinal sectional view of another conventional connector with the retainer assuming the preliminary engagement position.
Figure 10:
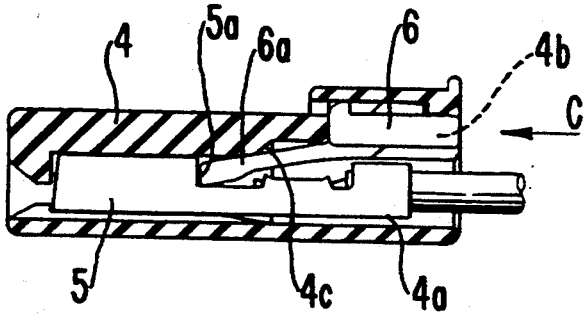
FIG. 10 (PRIOR ART)
FIG. 10 is a longitudinal sectional view of the connector shown in FIG. 9 with the retainer assuming the full engagement position.

As is obvious from the foregoing description, the retainer comprises the body and the lock strip(s). The body is engaged with the housing in a manner that allows it to be moved parallel to a longitudinal axis thereof. Each lock strip is engaged with the housing in such a manner that it will be pivoted toward and away from the housing when the retainer body is moved back and forth parallel to the housing. The protrusions on each lock strip invade the respective terminal receiving cavities from the opening of the housing when each lock strip is pivoted toward the housing. Then, the protrusions are engaged with the terminals in the cavities to hold them in position, respectively, thereby preventing them from backing out of the cavities. In this regard, no portion of the retainer needs to be flexed in the present invention although the arm of the retainer must be flexed in the prior art connector shown in FIGS. 9 and 10. Consequently, the operating force is less and the assembly efficiency is improved compared to this prior art connector.

In the condition that any one of the terminals is incompletely inserted in the cavity, the corresponding protrusion of the lock strip abuts the upper face of the tubular portion of that terminal. Consequently, since the retainer is inhibited from moving further forward, the incomplete insertion of the terminal in the cavity can be detected readily.

Each lock strip assumes both coplanar and inclined positions with respect to the retainer body during assembly of the connector. Consequently, the state of the engagement between the retainer and the housing can readily be confirmed on the basis of the inclination of each lock strip.

When the retainer body is moved rearwardly, each lock strip is pivoted by the guide means vertically outwardly relative to the housing. Accordingly, each lock strip reliably departs from the housing and the protrusions of each lock strip also come out of the respective cavities. Consequently, the terminal are not prevented from being removable from the housing even after many uses of the retainer.

Although the invention is applied to a female connector in the foregoing description, it may be applied to male connectors.

The foregoing disclosure and drawings are merely illustrative of the principles of the present invention and are not to be interpreted in a limiting sense. The only limitation is to be determined from the scope of the appended claims.

What is claimed is:

1. An electrical connector comprising:

a plurality of terminals;

a housing defining a plurality of cavities receiving said plurality of terminals therein, respectively, and an opening open to the terminal receiving cavities and an outer surface of the housing; and a retainer comprising a body engaged with the housing and movable parallel to a longitudinal axis thereof, and at least one lock strip coupled to the body and pivotable relative thereto, said lock strip and said housing including guide means for pivoting said lock strip inwardly toward and outwardly away from the housing as the retainer is moved parallel to the longitudinal axis of the housing in directions toward and away from the housing, respectively, said lock strip having protrusions extending into the opening of the housing, the protrusions moving inwardly and outwardly of the opening of the housing as the lock strip is pivoted toward and away from the housing, the protrusions engaging the terminals received in the cavities, respectively, such that the terminals are held in position by the retainer.

2. An electrical connector according to claim 1, wherein the guide means comprises a plurality of concave portions of the housing, and a plurality of guide protrusions formed on the retainer, each of said concave portions defining curved guide grooves into which the guide protrusions of said retainer extend, respectively, the lock strip being pivoted toward the housing via said guide protrusions as the retainer is moved parallel to the longitudinal axis of the housing in the direction toward the housing.

3. An electrical connector according to claim 2, wherein the retainer has at least one pair of holding strips, the holding strips holding the housing therebetween at outer sides of the housing.

4. An electric connector according to claim 2, wherein the housing has a guide recess extending parallel to the longitudinal axis of the housing, the guide grooves being formed to the sides of said guide recess, and the retainer has a guide convex portion extending into the guide recess of the housing, the guide protrusions being formed on opposite sides of the guide convex portion.

5. An electrical connector according to claim 3, wherein the retainer includes a tubular portion into which the housing is inserted.

6. An electrical connector according to claim 4, wherein the retainer includes a tubular portion into which the housing is inserted.

7. An electrical connector according to claim 3, wherein the body of said retainer has an open underside and a plurality of sliding strips holding the housing therebetween at outer sides of the housing.

8. An electrical connector according to claim 4, wherein the body of the retainer has an open underside and a plurality of sliding strips holding the housing therebetween at out sides of the housing.

9. An electrical connector according to claim 1, wherein said guide means comprises a curved guide groove extending in one of said housing and said retainer, and a protrusion extending from a portion of the other of said housing and said retainer into said curved guide groove.

10. An electrical connector as claimed in claim 1, wherein said retainer has a plurality of said lock strips.

* * * * *